US010308410B2

(12) United States Patent
Drzewiecki et al.

(10) Patent No.: US 10,308,410 B2
(45) Date of Patent: Jun. 4, 2019

(54) MULTIPLE-CONTAINER COMPOSITE PACKAGE

(71) Applicant: NESTEC S.A., Vevey (CH)

(72) Inventors: Frederic Drzewiecki, Vittel (FR); Bruno Mouthon, Martigny les Bains (FR)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 15/744,232

(22) PCT Filed: Jul. 15, 2016

(86) PCT No.: PCT/EP2016/066922
§ 371 (c)(1),
(2) Date: Jan. 12, 2018

(87) PCT Pub. No.: WO2017/013022
PCT Pub. Date: Jan. 26, 2017

(65) Prior Publication Data

US 2018/0201423 A1 Jul. 19, 2018

(30) Foreign Application Priority Data

Jul. 17, 2015 (EP) ..... 15177379

(51) Int. Cl.
*B65D 75/00* (2006.01)
*B65D 71/00* (2006.01)
(Continued)

(52) U.S. Cl.
CPC ..... *B65D 71/0085* (2013.01); *B65D 5/46016* (2013.01); *B65D 71/08* (2013.01);
(Continued)

(58) Field of Classification Search
USPC ..... 206/142, 143
See application file for complete search history.

(56) References Cited

U.S. PATENT DOCUMENTS 2,359,298 A * 10/1944 Brogden ..... B65D 71/0081 206/142
3,114,496 A 12/1963 Wilcox
(Continued)

FOREIGN PATENT DOCUMENTS

DE 1611987 2/1971
WO 2011030307 3/2011

*Primary Examiner* — Jacob K Ackun
(74) *Attorney, Agent, or Firm* — K&L Gates LLP

(57) ABSTRACT

A composite package (100) comprises a plurality of primary packages (104) and a handle (108) attached at two extremities (110, 708) thereof to said composite package (100), the plurality of primary packages (104) being gathered into several secondary packages (102*a*, 102*b*), wherein said handle (108) comprises at least one separation line (112) which divides said handle (108) into a plurality of sub-handles (114*a*, 114*b*) each attached at the extremities thereof to one of the secondary packages (102*a*, 102*b*), such that when one of said plurality of secondary packages (102*a*, 102*b*) is extracted from the composite package (100), said handle (108) separates along said at least one separation line (112) into a plurality of sub-handles (114*a*, 114*b*) each attached to said one of the secondary packages (102*a*, 102*b*) and retained therewith.

18 Claims, 3 Drawing Sheets

(51) Int. Cl.

| | |
|---|---|
| ***B65D 71/50*** | (2006.01) |
| ***B65D 75/56*** | (2006.01) |
| ***B65D 5/46*** | (2006.01) |
| ***B65D 71/08*** | (2006.01) |

(52) U.S. Cl.
CPC ..... *B65D 71/50* (2013.01); *B65D 75/56* (2013.01); *B65D 75/566* (2013.01); *B65D 2571/00024* (2013.01); *B65D 2571/00432* (2013.01)

(56) References Cited

U.S. PATENT DOCUMENTS

| | | | | |
|---|---|---|---|---|
| 5,758,818 | A * | 6/1998 | Ewing, Jr. ..... | B65D 5/5495 229/120.011 |
| 6,032,791 | A * | 3/2000 | Gresh, Jr. ..... | B65D 71/504 206/150 |
| 6,923,314 | B2 * | 8/2005 | Marco ..... | B65D 71/50 206/143 |
| 7,237,671 | B2 * | 7/2007 | Chambers ..... | B65D 21/0205 206/150 |
| 2014/0021073 | A1 * | 1/2014 | Rozner ..... | B65D 23/104 206/143 |

* cited by examiner

MULTIPLE-CONTAINER COMPOSITE PACKAGE

CROSS REFERENCE TO RELATED APPLICATIONS

The present application is a National Stage of International Application No. PCT/EP2016/066922, filed on Jul. 15, 2016, which claims priority to European Patent Application No. 15177379.3, filed on Jul. 17, 2015, the entire contents of which are being incorporated herein by reference.

FIELD OF THE INVENTION

The present invention concerns a composite package comprising a plurality of primary packages.

BACKGROUND OF THE INVENTION

It is well known to provide a number of different consumer products in the form of multiple-container packages, or "composite packages," wherein a quantity of individual containers are bundled together within an exterior packaging to form a single bundled package.

The individual containers are generally of an enclosed or sealed type, so as to maintain the quality of the product within; while the exterior packaging is configured to hold the individual containers together during storage and transport while at the same time being easily opened by the end user.

Such composite packages have been employed in many industries, but are particularly well-known in the food and beverage domain, where it is often desirable from a consumer perspective to purchase large quantities of certain products at once, but where the use of a single large container (e.g. a 5-liter bottle of mineral water) is disfavoured because of inconvenient handling or product degradation after opening. A single large container may also be more difficult to use than an equivalent volume of smaller products, particularly where a liquid product that is dispensed by pouring is involved.

These composite packages are advantageous in that they are generally easier to purchase and store than an equivalent amount of product in bulk form, in a single large container, or in a number of smaller containers purchased individually. Additionally, the exterior packaging may be assigned a unique UPC barcode or price tag, facilitating purchase and inventory.

Since a large number of containers are bundled together into one composite package, the resulting composite package may be quite bulky and difficult to carry in one hand. To this end, means such as handles are generally provided, to facilitate the manipulation and transport of the composite package.

However, these composite packages can be nonetheless uncomfortable and fatiguing to carry in one hand, as composite packages enclosing a large number of containers can be heavy and unwieldy to carry. Such heavy packages can also create a high degree of muscle and joint strain in the user; for instance, particularly bulky composite packages tend to force the user to carry them with his/her arms slightly extended from the body, which forces a pronation of the wrists and strains unnecessarily the arm and wrist muscles. Likewise, carrying a large, heavy package in one hand can make it difficult for the user to maintain equilibrium; such an unbalanced load may, over time, lead to back pain or other orthopaedic ailments in the user.

In the composite packages known in the art, one means of remedying this is to break open the package and remove the individual containers within. However, by doing so, the advantages of having a single composite package with a handle are lost.

Alternately, it is known to provide composite packages which only contain 2 or 4 of the individual containers. However, such an arrangement is not satisfactory, in that in order to yield a composite package with a sufficient volume of product, the individual packages must themselves be rather large and unwieldy. There is thus a need to provide a composite package which resolves at least some of the disadvantages discussed above.

SUMMARY OF THE INVENTION

Accordingly, there is provided a composite package comprising a plurality of primary packages and a handle attached at two extremities thereof to said composite package.

According to the invention, the plurality of primary packages are gathered into a plurality of secondary packages each containing at least one of said primary packages, said handle having at least one separation line extending along the length thereof and dividing said handle into a plurality of sub-handles each attached at the extremities thereof to one of the secondary packages such that when one of said plurality of secondary packages is extracted from the composite package, said handle is torn along said at least one separation line, the sub-handle attached to said one of said plurality of secondary packages being retained therewith.

A composite package so configured is advantageous in that when the user splits the handle along the at least one pre-cutting line to separate one or more of the secondary packages from the composite package, the secondary packages remain intact, while separating the handle in such a way that each of the secondary packages has a sub-handle attached to it. The consumer may then use the sub-handle to carry and manipulate the secondary package in the same way as the handle is used to carry and manipulate the composite package.

In this way, the single, large composite package is divided into two or more smaller secondary packages. The secondary packages are of a lesser weight and smaller size than the composite package. At the same time, the retention of the sub-handles on each of the secondary packages ensures that the secondary packages can be easily manipulated and transported.

Thus, the flexibility and user-friendliness of the composite package is maximized.

In a possible embodiment, at each extremity of the handle there is provided an attachment region comprising a plurality of strips extending from said extremity of said handle at an attachment angle relative to the extension of the centreline of said handle, each of said strips attaching one of the sub-handles to one of the secondary packages.

This is advantageous in that the strips, disposed at the attachment angle, will position the secondary package in the most ergonomically-correct position possible when the secondary package is extracted from the composite package and held by its sub-handle.

Specifically, the angled application of the strips will counteract any off-centre positioning of the centre of gravity of the secondary package that occurs when said secondary package is extracted from the composite package.

In this way, excessive pronation of the user's hand when lifting the secondary package by its sub-handle is avoided. The composite package is thereby rendered more comfortable and efficient to use.

Preferably, the width of each of the plurality of strips is substantially equal to the width of the corresponding sub-handle.

This is advantageous in that the strength of the attachment between the handle and the composite package is maximized while minimizing the concentration of tensile stresses that might otherwise occur in the handle due to the discontinuity in width at the interface of the strip and the sub-handle.

In a possible embodiment, each attachment region is constituted by a single adhesive tape, said adhesive tape being cut over the portion thereof extending from the extremity of the handle, thereby constituting the plurality of strips.

This is advantageous in that the single adhesive tape will maximize the strength of the handle-package joint, thereby maximizing the size of composite package that may be achieved.

In another possible embodiment, each attachment region is constituted by a plurality of adhesive tapes each extending from said extremity.

This is advantageous in that a plurality of strips is most efficient to apply, in that depending on the width of the sub-handles, the plurality of strips may be all furnished in the same length and width, and in any event require no cutting or manipulation to apply to the handle and composite package.

Preferably, the attachment angle is between 10° and 60°.

Most preferably, the attachment angle is between 10° and 30°.

This is advantageous in that it will result in the most stable and comfortable distribution of the weight of the secondary package when it is separated from the composite package and carried by the sub-handle. This will, in turn, reduce fatigue and discomfort for the person carrying the secondary package so separated.

Preferably, the width of the handle at each of the two extremities thereof is between 10 millimeters and 80 millimeters.

Most preferably, the width of the handle at each of the two extremities thereof is between 40 millimeters and 60 millimeters.

Such widths are optimal for the dimensions and weights most frequently encountered in composite packages for consumer products.

In a possible embodiment, the handle has a reduced width at a central region of said handle.

This is advantageous in that when the primary containers are bottles, the handle will be naturally induced to lie between the two secondary packages when the composite package is lifted.

In a possible embodiment, each of the sub-handles has a substantially equal width.

In this way, the fabrication of the handle, as well as the positioning and attachment of the adhesive tape(s) is simplified.

Preferably, the handle is oriented parallel with or perpendicular to a longitudinal dimension of the composite package.

This is advantageous in that, when the secondary packages are extracted from the composite package and carried by the user in an arms-down position, the primary containers within the secondary packages are carried as closely to the body as possible.

In this way, joint and muscle strain on the user's hands and arms are minimized, reducing fatigue and improving the ergonomics of the composite package.

Preferably, the separation line comprises at least one pre-cutting line extending over the entire length of said separation line.

This is advantageous in that as the pre-cutting line is broken, the separation of the sub-handles is performed in a simple and precise manner. Such a configuration avoids the inherent difficulty of creating a straight free-hand tear in a non-perforated material. The strength and integrity of the sub-handles is thereby preserved, maximizing the usability of the composite package.

Alternatively, the at least one separation line comprises a pre-cutting extending over a part of the length of said at least one separation line, said at least one separation line remaining un-perforated at the extremities of the handle.

This is advantageous in that the extremities of the handle maintain their maximum strength, thereby maximizing the weight of the composite package and increasing its resistance to inadvertent separation of the secondary packages comprised within.

In a preferable embodiment, at least one of the secondary packages comprises a plurality of primary packages disposed in a linear or close-packed arrangement.

This is advantageous in that such arrangements facilitate the fabrication, transport, storage, and use of the composite package.

A linear arrangement is particularly advantageous in that, as the linear arrangement aligns the primary packages within the secondary packages along a grid, the resulting secondary packages and composite package have a substantially rectangular footprint and parallelpipedal form; this tends to facilitate the stocking, transport, and storage of the packages in warehouses, store shelves, etc. which are generally adapted to rectilinear packages.

Alternately, the close-packed arrangement of the primary packages will maintain a maximum of stability and structural strength in the secondary package once it is separated from the composite package. Close-packed arrangements also tend to realize the best possible packing ratio, containing the greatest possible volume of product within a given volume.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
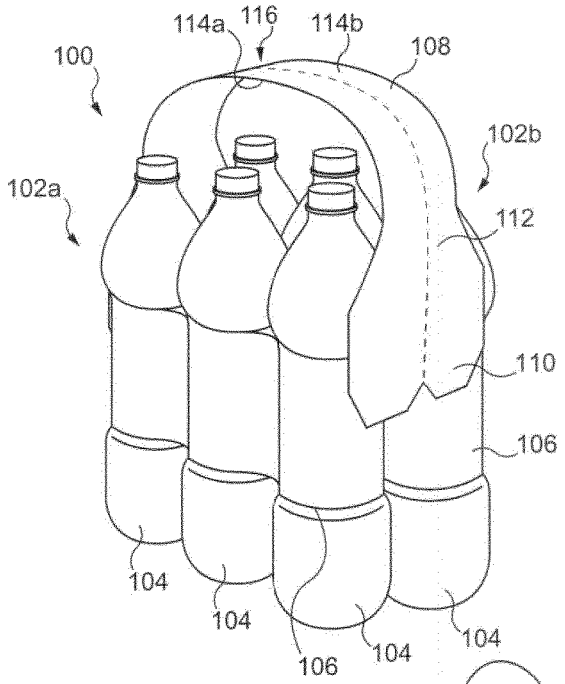
FIG. 1 is a composite package according to a first embodiment of the invention.

FIG. 1 illustrates a composite package 100 according to a first embodiment of the invention. The composite package 100 comprises two secondary packages 102*a* and 102*b*, each of which comprises three primary packages 104.

The primary packages 104 are packages of a product of a size that would be appropriate for individual purchase and consumption; the inclusion of several of the primary packages 104 into the composite package is therefore done to facilitate the purchase of several primary packages at once, as described above. It will be understood, then, that the size and number of the primary packages 104 is therefore a function of the product contained therein, and may vary from what is depicted here.

Within each of the secondary packages 102*a*, 102*b*, the primary packages are grouped together and bound by a band 106. The two bands 106 serve to hold the primary packages 104 in position relative to each other, and give the secondary packages 102*a*, 102*b* a degree of structural strength and rigidity.

It will be noted that in other implementations of the invention, the band may be supplemented or replaced by other means such as plastic strapping, shrink-wrapping, or the like, as appropriate to the particular application in question.

The composite package 100 is further provided with a handle 108. The handle 108 is attached to the secondary packages 102*a*, 102*b* at its two extremities 110, of which one is visible here. The means for connecting the handle 108 to the secondary packages 102*a*, 102*b* is discussed in further detail below.

The handle 108 is provided with a pre-cut separation between the secondary packages 102*a*, 102*b*, in the form of a separation line 112 which lies along the centreline of the handle 110 and divides it into sub-handles 114*a*, 114*b*. The width of the handle 108 is generally chosen so as to correspond to the total weight of the primary packages 104 within the composite package 100; generally speaking, however, it will be between 10 and 80 mm, and most frequently between 40 and 60 mm, as these are the dimensions which fit most comfortably in the human hand.

It will be noticed that the sub-handles 114*a*, 114*b* are here of a substantially equal width. This is because the two secondary packages 102*a*, 102*b* contain equal amounts of product within the primary packages 104.

As a general rule, it is desirable to provide a wider handle for a heavier load: this may implicate forming the handle from a longer, thicker, and/or wider tape, providing a localized region of increased width and/or thickness, or some combination thereof. Moreover, the dimensions of each sub-handle 114 should ideally reflect the proportion between the total weight of the product within its respective secondary package 102 and the total weight of product in the entire composite package 100.

Of course, the person of ordinary skill in the art will be able to determine the optimal width for each of the sub-handles in any specific application.

It should also be noted that, in this embodiment, the perforation line 112 extends substantially over the entire length of the handle. However, the perforation line 112 does not extend right to the edge of the handle 108. This is so that the perforation line 112 does not tear prematurely as a result of the forces exerted upon the composite package 100 during normal handling.

The fabrication of the handle 108 will now be discussed. The handle 108 is, in this embodiment, fabricated from a single length of material having a width substantially equal to that of the handle 108 where it attaches to the secondary package 102*a*, 102*b* at the extremities 110. The adhesive tape is preferably pre-cut so as to form the reduced width over the majority of the length of the handle 108 that is particularly apparent in FIG. 1.

The handle can be fabricated in a number of different configurations and materials. For instance, the handle may be fabricated from a simple elongate piece of flat material, such as paper- or cardboard, plastic or foam material, or other materials as appropriate.

By way of example, in this embodiment the handle 108 is fabricated from a piece of adhesive plastic tape. In order to allow having a gripping portion (not sticky), a gripping member (not represented) in the form of a flat member of moderate rigidity is positioned over a portion of the length of the handle on the adhesive side of the handle. The remaining adhesive portions over the length of the handle are located at the extremities 110 of the handle and are attached to the secondary package 102*a*, 102*b*. Such a configuration is advantageous in that such tapes can be easily produced and manipulated in high-speed, continuous manufacturing environments. However, other configurations are certainly possible.

It may also be desired to provide reinforcement to the handle. This will be discussed in further detail below with reference to FIG. 6.

Figure 2:
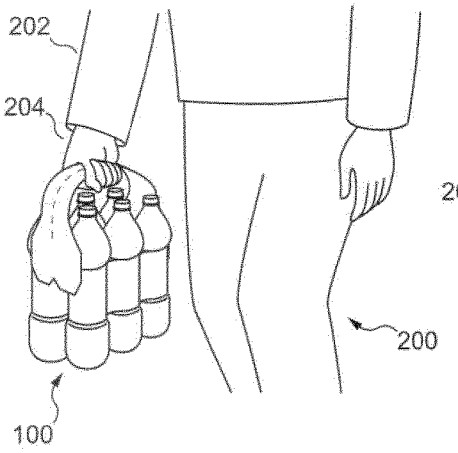
FIG. 2 is the composite package according of FIG. 1, being carried by a user.

With reference to FIGS. 1 and 2, it is seen that the handle 108 is oriented to extend along a longitudinal direction of the composite package 100; that is, parallel with the longest dimension of the composite package 100. The effect of this is apparent in FIG. 2, where a user 200 carries the composite package 100 with the handle substantially parallel to said user 200's sagittal plane (i.e. the plane passing vertically through the spinal column and solar plexus). Such an orientation is more comfortable for the bones and musculature of the arm 202 and wrist 204 of the user 200, in that it results in the least amount of strain when the composite package 100 is of a moderate to heavy weight. Most notably, pronation and flexion of the wrist 204 is reduced, relative to those multi-container packages known in the art wherein a handle is disposed transversally.

It will also be noted that the handle 108 is of a reduced width at a central region 116 relative to the extremities 110. This is advantageous in that the diminished width enables the handle to slip between the primary containers 106 when the composite package is lifted by the handle 108. Moreover, the increased width at the extremities 110 facilitates the attachment of the handle 108 to the secondary packages 102*a*, 102*b*.

Of course, it may in other embodiments be preferable to furnish the handle as a strip of uniform width. This will minimize manufacturing costs as such a configuration eliminates the need to cut or otherwise shape the handle.

Figure 3:
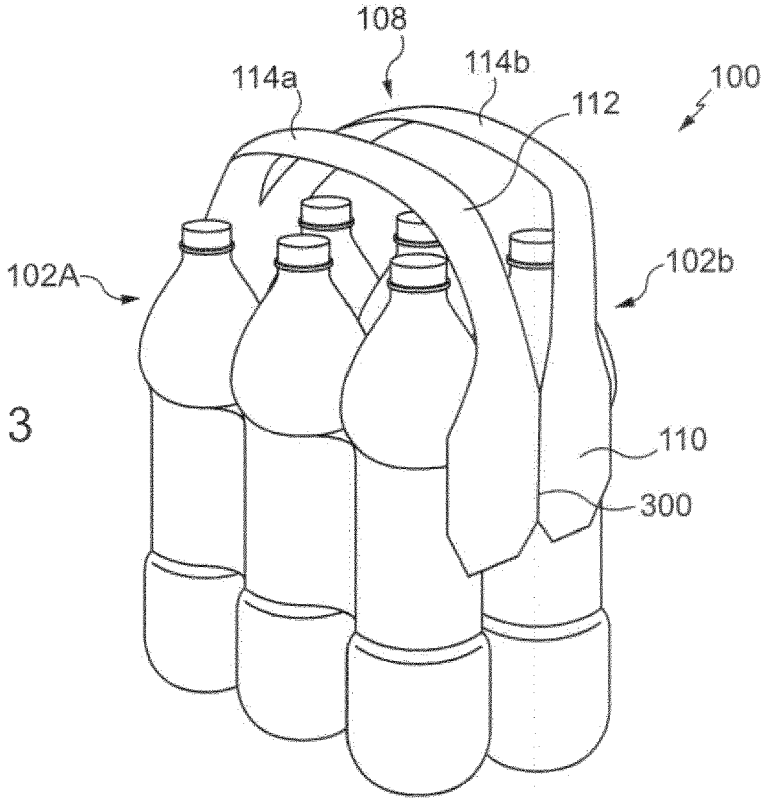
FIG. 3 is the composite package of FIG. 1, wherein the handle is partially split into two sub-handles.

Turning now to FIG. 3, the composite package 100 is shown with the handle 108 partially separated into the two sub-handles 114*a*, 114*b*.

In particular, it can be seen that the pre-cutting along the separation line 112 has been completely torn open, and only the un-perforated parts of the handle 108 at the extremities 110 remain intact.

When the user 200 further separates the secondary packages 102*a*, 102*b*, the extremities 110 will separate along the un-perforated portion 300 of the separation line 112. This is because the tearing of the pre-cutting along the separation line 112 naturally creates a preference in the material of the handle 108 for further tearing in the same direction.

Of course, depending on the material and construction of the handle, this may not be sufficient in all conceivable applications to ensure a clean, even separation of the sub-handles. It should therefore be understood that, in other embodiments of the invention, the pre-cutting of the separation lines may extend over the entire length of the handle, right up to the ends of the extremities.

In such a case, it will be understood that, despite the presence of the precut over substantially the entire length of the handle, the handle will remain intact, without a precut, at the very edge thereof, so as to avoid any inadvertent tearing of the handle.

Alternately, other means of controlling the separation of the sub-handles (e.g a crease) may be envisioned to induce a clean, even tear in the handle material. The exact configuration will depend on the particular implementation in question.

The pre-cutting can be formed by any conventional means, for instance mechanical cutting or laser cutting or burning. Laser cutting may be particularly advantageous in embodiments such as the one depicted here, in that since the pre-cutting may be easily interrupted by controlling the laser; in this way the un-perforated region at the extremities 110 of the handle 108 are easily produced. This may be particularly advantageous in high-speed, high-volume production operations.

It should be noted that a handle as according to the present is particularly advantageous, in that it provides an excellent degree of flexibility in how it can be fabricated and implemented during package fabrication. For instance, in one possible implementation the handles may be fabricated from a flat sheet of a plastic membrane, which is coated with an adhesive, given a paper backing and subsequently die-cut to separate individual, pre-cut handles therefrom. In another possible embodiment the handles are formed in a continuous process, such that the handles are cut from the tape, pre-cut to form the sub-handles, and attached to composite packages. The particular manufacturing implementation can be tailored as appropriate to the composite packages in question and the rate at which they are to be produced.

Figure 4:
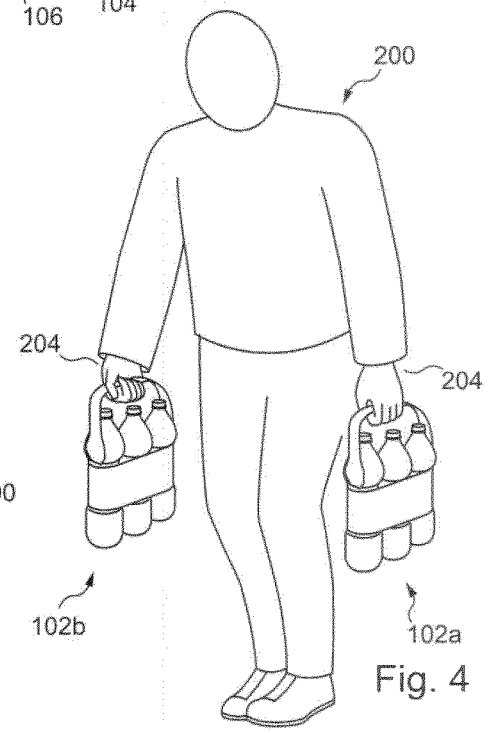
FIG. 4 is the composite package of FIG. 1, split into two secondary packages and being carried by a user.

FIG. 4 depicts the user 200 carrying the two secondary packages 102*a*, 102*b*. The two secondary packages 102*a*, 102*b* are now completely separated, the handle 108 having been torn along the extension line 300 depicted in FIG. 3.

The user 200 is, as a result, able to carry one secondary package 102*a*, 102*b* in each hand, rather than carrying the entire composite package 100 in one hand as depicted in FIG. 2. This gives the user 200 a greater degree of balance and comfort, as the weight of the primary packages 106 is now distributed more evenly.

Furthermore, pronation and flexion of the wrists 204 of the user 200 is further reduced, in that as the secondary packages 102*a*, 102*b* are narrower than the composite package 100, the user can carry them carried closer to the body, with his arms nearer to a vertical position. In this way a further improvement in comfort is achieved.

Figure 5:
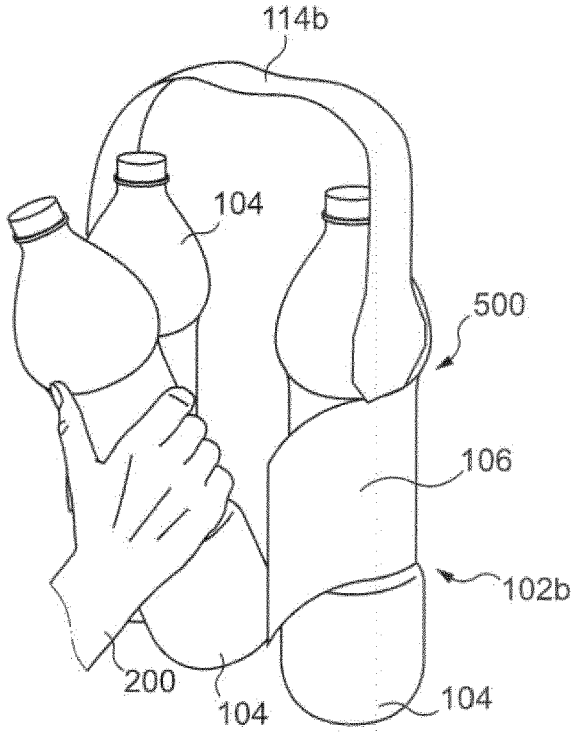
FIG. 5 is a secondary package of the composite package of FIG. 1.

FIG. 5 depicts the separated secondary package 102*b* in greater detail. The secondary package 102*b*, though separated from the composite package, retains the sub-handle 114*b* which corresponds to it; likewise, the secondary package 102*a* (not shown) retains the sub-handle 114*a*. And because of the band 106, the secondary package 102*b* will retain its structural integrity, allowing it to be stored, transported, and manipulated with ease.

When the secondary package(s) are extracted from the composite package, it may be the case that certain surfaces are exposed to view which would have remained hidden or obscured by the primary packages within the composite package.

Indeed, when the secondary package 102*b* is extracted from the composite package, an interior face 500, previously hidden within the composite package, is now exposed.

The exposure of such a surface offers an increased degree of flexibility. For instance, a secondary barcode may be printed on the interior face 500, assigning a UPC number for the secondary package 102*b*.

This gives a great deal of flexibility to the consumer and to the seller, permitting the purchase of the entire composite package 100 in its initial state; one or more of the secondary packages 102*b* which have been extracted from a composite package 100; or even one or more of the primary packages 104 which have been taken from a broken-open secondary package 102.

Additionally, other complementary information such as promotional messages, recipes, supplementary instructions, etc. may be disposed on the surface area offered by the interior face 500.

Thus, the secondary package 102*b* having been extracted from the composite package, the user 200 can then break the band 106, so as to remove a primary container 106 for consumption of the product contained therein.

Figure 6:
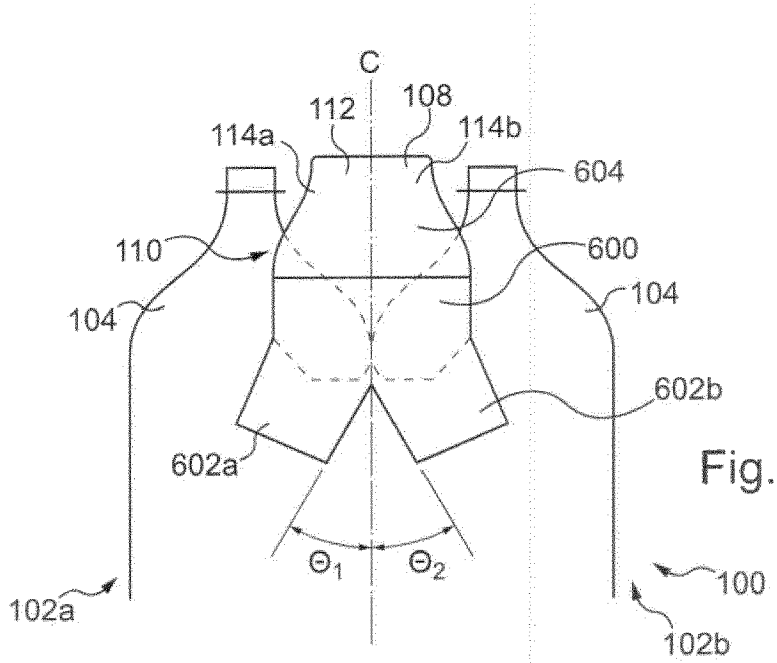
FIG. 6 is a detail view of the composite package of FIG. 1.

FIG. 6 is a detail view of the attachment of one extremity 110 of the handle 108 to the secondary packages 102*a*, 102*b*.

At the extremity 110, the handle 108 has an attachment region 600. The attachment region 600 is essentially a portion of the surface of the handle 108 at the extremity 110 which is configured to be attached to one or more of the primary packages 104, thereby retaining the handle 108 to the secondary packages 102*a*, 102*b*. This adhesion is most commonly achieved by the way of glue or other adhesive substance, though other means of attaching the handle 108 may be possible.

The attachment of the handle 108 will now be discussed in further detail. First, it will be noted that the attachment region 600 is partially split, forming from it strips 602*a*, 602*b*. The two strips 602*a*, 602*b* are angled away from a centreline 604 of the composite package 100, at the angles of attachment $\theta_1$, $\theta_2$.

The attachment of the two strips 602*a*, 602*b* to the secondary packages 102*a*, 102*b* achieves several results. First, when the composite package 100 is whole, the angled attachment serves to permit the disposition of the handle 108 between the secondary packages 102*a*, 102*b*, and to support the weight of the two secondary packages 102*a*, 102*b* without any tearing or slipping where the strips 602*a*, 602*b* are attached to said secondary packages 102*a*, 102*b*.

Second, when the secondary packages 102*a*, 102*b* are extracted from the composite package 100 and carried individually, as depicted e.g. in FIG. 4, the off-centre attachment of the sub-handles 114*a*, 114*b* will tend to cause the secondary packages 102*a*, 102*b* to rotate outwards. The attachment of the strips 602*a*, 602*b* at an angle $\theta_1$, $\theta_2$ relative to the centreline 604 means that any twisting or shear of the handle 108 at attachment region 600 will be minimized.

It will also be noted that, in FIG. 6, the angles of attachment $\theta_1$, $\theta_2$ are equal, as the composite package is symmetrical across the centreline 604. It will be readily understood that the angles of attachment may vary from one side to the other, and in any case will depend on the exact dimensions of the primary containers 104 and the configuration of the composite package 100. However, in most cases the angle of attachment will be between 10° and 60°, and most frequently between 10° and 30° for the most commonly-encountered applications.

The structure of the handle 108 in the form of a single piece of adhesive plastic table has already been presented.

Additionally, the handle may comprise a reinforcement means, which may be of particular utility where the composite package is particularly heavy or where it is desirable to provide extra padding for where the user will seize the handle.

Thus, in the present embodiment, the reinforcement is provided in the form of a backing member 604 in replacement to the gripping member thereby bringing more comfort to the end user. The backing member 604 is a flat member of moderate rigidity, which is laminated to the handle 108, over a portion of the length thereof.

More specifically, as the handle 108 of the present invention is an adhesive tape, as discussed above with reference to FIG. 1, the backing member 604 is simply affixed to the adhesive side of the handle 108. This is particularly advantageous, in that it simplifies the process for manufacturing the handle; the attachment region 600 is effectively delimited by the backing member 604.

Moreover, such a configuration is advantageous in that it can facilitate the assembly of the composite package 100. By providing the handle and the backing member in such a laminated form, it may be advantageous to provide the handle 180 in a pre-cut form where an excess portion of the material from which the backing member 604 is fabricated covers and protects the attachment regions 600. In such a case, the assembler would need merely to peel off the excess backing member material to expose the adhesive attachment regions 600, then apply the handle 108.

Figure 7:
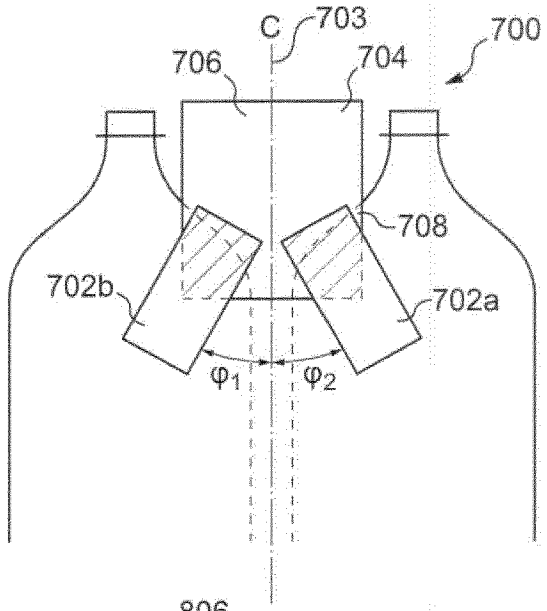
FIG. 7 is a detail view of a composite package according to a second embodiment of the invention.

FIG. 7 depicts a variant embodiment of the invention. In FIG. 7, a composite package 700 is provided adhesive tape strips 700*a*, 700*b*, which are respectively disposed relative to a centreline 703 at the attachment angles $\varphi_1$, $\varphi_2$. Moreover, a handle 704 is provided in a different configuration than the embodiment discussed with respect to FIGS. 1-6: a pre-cut perforation line 706 is provided with a pre-cutting that extends over the entire length of the handle 704, and the handle 704 is of a uniform width over its entire length.

The adhesive tape strips 702*a*, 702*b* are here simply affixed to the extremity 708 of the handle; no cutting, slicing, or other such manipulation is required beyond that which is necessary to provide the tape strips 702*a*, 702*b* in the correct length. The adhesive tape strips 702*a*, 702*b* therefore constitute the attachment region of the handle 704.

A composite package 700 configured this way can therefore be fabricated with great efficiency, as the amount of material handling and fabricating operations required are minimized. A composite package such as depicted in FIG. 7 is thus particularly well-suited for high-speed, high-volume production.

Figure 8:
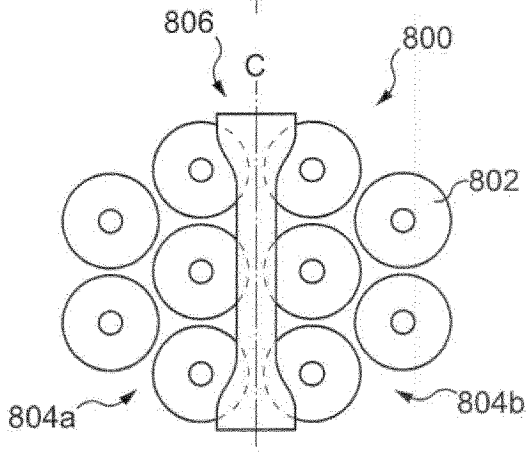
FIG. 8 is a schematic view of a composite package according to a third embodiment of the invention.

FIG. 8 is a top view of a composite package 800 according to a third embodiment of the invention. As in the embodiments previously depicted, the composite package 800 comprises a plurality of primary packages 802 grouped into secondary packages 804*a*, 804*b*, and provided with a handle 806.

In the embodiment of FIG. 8, however, the primary packages 802 are grouped in a close-packed arrangement. This close-packed arrangement will give an additional measure of structural strength and rigidity to the secondary packages 804*a*, 804*b* when the two are extracted from the composite package 800.

Such a close-packed arrangement also maximizes the number of primary packages 802, and thus the total volume of product, that can be stored in a given volume of space. The storage, shipping, and stocking for sale of the composite packages are thereby optimized.

While the embodiments described in the preceding discussion illustrate the invention, it will be understood that variations are possible without departing from the overall scope of the invention.

For instance, it will be well understood that the actual number and configuration of the primary and secondary packages may be varied. For instance, there may be provided three secondary packages of four primary packages each, or two secondary packages of four primary packages each, or any other such permutation as may be desirable and appropriate. It may also be the case that one or more of the secondary packages consists of a single, large primary container. In any event, the handle will be divided into as many sub-handles as there are secondary packages, each sub-handle corresponding to one of the secondary packages.

Also, it may be desirable to apply other techniques and structures known in the packaging arts. For instance, it may be advantageous to provide an envelope, such as one fabricated from stretchable or heat-shrunk plastic film, to form the secondary and/or composite packages. Forming the secondary and/or composite packages with an envelope will help to maintain their structural integrity and facilitate their handling during transport, sale, and use.

Finally, other means of attaching the handle to the secondary packages, such as hot glue or thermal bonding, may be envisioned. Such means can be selected by the person of skill in the art as appropriate for the size, form, weight, and material properties of the packages in question.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A composite package comprising a plurality of primary packages and a handle attached to the composite package at two extremities of the handle, the plurality of primary packages are gathered into a plurality of secondary packages each containing at least one of the plurality of primary packages, and the handle has at least one separation line extending along a length of the handle and dividing the handle into a plurality of sub-handles each attached at the two extremities to one of the plurality of secondary packages, such that when one of the plurality of secondary packages is extracted from the composite package, the handle is torn along the at least one separation line, one sub-handle attached to the one of the plurality of secondary packages being retained therewith, each extremity of the handle comprises an attachment region comprising a plurality of strips extending from the two extremities of the handle at an attachment angle relative to an extension of a centerline of the handle, each of the plurality of strips attaching one of the plurality of sub-handles to one of the plurality of secondary packages.

2. The composite package according to claim 1, wherein a width of each of the plurality of strips is substantially equal to a width of a corresponding sub-handle.

3. The composite package according to claim 1, wherein each attachment region is constituted by a single adhesive tape, the single adhesive tape being cut over a portion extending from a corresponding extremity of the handle, thereby constituting the plurality of strips.

4. The composite package according to claim 1, wherein each attachment region is constituted by a plurality of adhesive tapes each extending from a corresponding extremity of the handle.

5. The composite package according to claim 1, wherein the attachment angle is between 10° and 60° .

6. The composite package according to claim 1, wherein the attachment angle is between 10° and 30° .

7. The composite package according to claim 1, wherein a width of the handle at each of the two extremities is between 10 millimeters and 80 millimeters.

8. The composite package according to claim 1, wherein a width of the handle at each of the two extremities is between 40 millimeters and 60 millimeters.

9. The composite package according to claim 1, wherein the handle has a reduced width at a central region of the handle.

10. The composite package according to claim 1, wherein each of the plurality of sub-handles has a substantially equal width.

11. The composite package according to claim 1, wherein the handle is oriented parallel with or perpendicular to a longitudinal dimension of the composite package.

12. The composite package according to claim 1, wherein the at least one separation line comprises at least one pre-cut extending over the entire length of the at least one separation line.

13. The composite package according to claim 1, wherein the at least one separation line comprises a pre-cut extending over a part of a length of the at least one separation line, the at least one separation line remaining un-perforated at the extremities of the handle.

14. The composite package according to claim 1, wherein at least one of the plurality of secondary packages comprises the plurality of primary packages disposed in a linear or close-packed arrangement.

15. The composite package according to claim 1 comprising an interior surface comprising information of the composite package, the interior surface is hidden within the composite package and/or obscured by the plurality of primary packages, the one of the plurality of secondary packages being extracted from the composite package exposing the interior surface.

16. The composite package according to claim 1, wherein the handle comprises a backing member laminated to the handle over a portion of the length of the handle.

17. The composite package according to claim 1, wherein the handle comprises an adhesive tape.

18. The composite package according to claim 17, wherein the handle comprises a backing member affixed to the adhesive tape.

* * * * *